US008388214B1

(12) United States Patent
Toro et al.

(10) Patent No.: US 8,388,214 B1
(45) Date of Patent: Mar. 5, 2013

(54) LIGHTED RAILING AND SIMILAR STRUCTURES

(75) Inventors: Joseph Toro, Port Jefferson Station, NY (US); Steven Hamblin, Daleville, VA (US); Patrick B. McLane, Scranton, PA (US); Michael Gori, Peckville, PA (US)

(73) Assignee: AZEK Building Products, Inc., Scranton, PA (US)

( * ) Notice: Subject to any disclaimer, the term of this patent is extended or adjusted under 35 U.S.C. 154(b) by 0 days.

(21) Appl. No.: 13/345,970

(22) Filed: Jan. 9, 2012

(51) Int. Cl.
*F21V 21/34* (2006.01)

(52) U.S. Cl. ..... 362/648; 362/147; 362/404

(58) Field of Classification Search ..... 362/648, 362/147, 404, 219, 391, 431
See application file for complete search history.

(56) References Cited

U.S. PATENT DOCUMENTS 3,867,621 A 2/1975 Gewfrtz et al.
5,343,375 A 8/1994 Gross et al.
6,619,814 B1 9/2003 Hamada et al.
7,648,251 B2 1/2010 Whitehouse et al.
2007/0133192 A1 6/2007 Alessandro
2008/0285264 A1 11/2008 Whitehouse et al.
2009/0051517 A1 2/2009 Suzuki
2009/0200966 A1 8/2009 Whitehouse et al.
2010/0277898 A1 11/2010 Murray et al.

*Primary Examiner* — Joseph L Williams

(74) *Attorney, Agent, or Firm* — Buchanan Ingersoll & Rooney PC

(57) ABSTRACT

A decorative lighting system has a light holding assembly, a base section member, and a top section member on the base section member. The light holding assembly has an elongated tubular body having a cavity defined therein, a flange extending from the elongated tubular body, and a plurality of lights within the elongated tubular body. At least a portion of the elongated tubular body is made of a material that allows light to pass through that portion. In addition, at least a portion of the flange is between the base section member and the top section member such that the light holding assembly is held between the base section member and the top section member.

20 Claims, 6 Drawing Sheets

LIGHTED RAILING AND SIMILAR STRUCTURES

BACKGROUND OF THE INVENTION

1. Field of the Invention

The present invention relates to improvements in lighting systems. More particularly the invention relates to providing lighting around a railing or trim systems.

2. Description of the Related Art

Lighting systems are generally applied around areas of a home or building structure to provide light where there is insufficient illumination. The goal is typically to provide a safe environment. Additionally, lighting systems are used to provide a decorative or aesthetically pleasing appearance to those areas of a home or building structure. Such areas include patios, staircases, doorways, windows, or around molding or trim.

Typically such exterior lighting systems comprise simple lights hung near a door, flood lamps, or seasonal light strings placed around an area where light is desired. In an interior, such lighting systems may consist of track lighting or crudely hung seasonal light strings.

In addition, railing and trim assemblies are used in a variety of applications and may provide a functional and/or decorative feature for a house or other structure. Recently, these assemblies have been manufactured from plastics such as high-density polyurethane and other alternatives to natural wood.

In general, such assemblies have gathered attention because they provide lower maintenance and simpler installation at a lower cost than traditional wood construction. Plastic railing and trim assemblies are nearly impervious to moisture and therefore will not rot or decay like natural wood. Further, during the manufacture of these assemblies, plastic can be tinted with dyes or other materials to provide a specific color to a component, thus removing the need for surface preparation and painting prior to or subsequent to installing the trim assembly.

An example of such a railing assembly is provided in U.S. Pat. No. 6,702,259. U.S. Pat. No. 6,702,259 discloses guard rail system that includes a handrail and a top retainer that may be manufactured through an extrusion process. The hand rail is slip fitted over the top retainer in a locking relation. This handrail/retainer combination forms an integrated rail section and may be combined with other rail sections and end posts to form a safe and aesthetically appealing railing for a deck, porch, or stairs.

Current lighting systems that are applied around a railing or trim assembly typically require costly installation or may otherwise lack an appropriate aesthetic appearance. In addition, traditional lighting may not provide illumination around such features where light is ultimately desired. Furthermore, current lighting systems do not take advantage of the simple installation that is offered by modern railing or trim assemblies and have not been incorporated into the construction process of these assemblies.

Thus there is a need for a decorative lighting system that is easy to manufacture and install, and allows for installation around modern railing or trim systems.

SUMMARY OF THE INVENTION

A decorative lighting system is disclosed herein that has a light holding assembly, a base section member, and a top section member on the base section member. The light holding assembly has an elongated tubular body that has a cavity defined therein, a flange extending from the elongated tubular body, and a plurality of lights within the elongated tubular body. At least a portion of the elongated tubular body is made of a material that allows light to pass through that portion.

Additionally at least a portion of the flange is installed between the base section member and the top section member of a railing such that the light holding assembly is held between the base section member and the top section member.

In a preferred embodiment of the decorative lighting system a portion of the light holding assembly is covered by a material that is opaque.

In another preferred embodiment of the decorative lighting system the light holding assembly is made by an extrusion process.

In yet another preferred embodiment of the decorative lighting system the light holding assembly is made of a resilient material.

In a further preferred embodiment of the decorative lighting system a cross section of the cavity has a substantially trapezoidal shape.

In still a further preferred embodiment of the decorative lighting system a cross section of the cavity has a shape that is substantially the shape of a letter D.

In still another preferred embodiment of the decorative lighting system an angle equal to 90 degrees or less than 90 degrees is formed between the flange and the tubular body of the light holding assembly.

In a further preferred embodiment of the decorative lighting system the elongated tubular body has a light transmissive section, and wherein the light transmissive section of the elongated tubular body is not enclosed by the base section member and the top section member.

In still a further preferred embodiment of the decorative lighting system light transmitted by the light transmissive section is projected in a direction that is away from the top section member.

In another preferred embodiment of the decorative lighting system the plurality of lights are a plurality of Light Emitting Diodes.

In yet another preferred embodiment of the decorative lighting system the plurality of lights comprise a flexible strip of lights.

In still another preferred embodiment of the decorative lighting system the light holding assembly has a length that is equal to a factor of a length of the base section member or a length the top section member.

In a further preferred embodiment of the decorative lighting system a plurality of lights comprises a strip of Light Emitting Diodes and the strip has designated cut areas.

In still a further preferred embodiment of the decorative lighting system the light holding assembly is held between the base section member and the top section member by an interference fit.

Further disclosed herein is a lighted railing that has a light holding assembly, a retainer, and a railing cover on the retainer. The light holding assembly has an elongated tubular body with a cavity defined therein, a flange extending from the elongated tubular body, and a plurality of lights within the elongated tubular body. At least a portion of the elongated tubular body is made of a material that allows light to pass through that portion. In addition, at least a portion of the flange is between the retainer and the railing cover such that the light holding assembly is held between the retainer and the railing cover.

Also disclosed herein is a kit for a decorative lighting system that has a light holding assembly, a base section member, and a top section member that is sized and configured to connect to the base section member. The light holding assembly has an elongated tubular body that has a cavity defined therein, and a flange extending from the tubular body. At least a portion of the tubular body is made of a material that allows light to pass through that portion and at least a portion of the flange is sized to fit between the base section member and the top section member such that the light holding assembly is held between the base section member and the top section member when they are connected.

In a preferred embodiment the kit further comprises a plurality of lights sized to fit within the elongated tubular body of the light holding assembly.

Other details, objects, and advantages of the invention will become apparent as the following description of certain present preferred embodiments thereof proceeds.

BRIEF DESCRIPTION OF THE FIGURES

In the accompanying drawing I have shown certain present preferred embodiments of our decorative lighting system in which.

DESCRIPTION OF THE PREFERRED EMBODIMENTS

Figure 1:
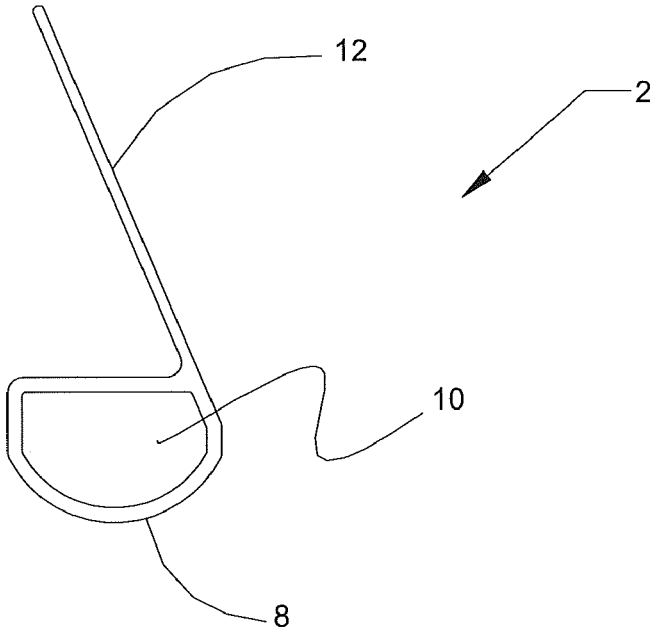
FIG. 1 is an end view of a present preferred embodiment of the light holding assembly of our decorative lighting system.
Figure 2:
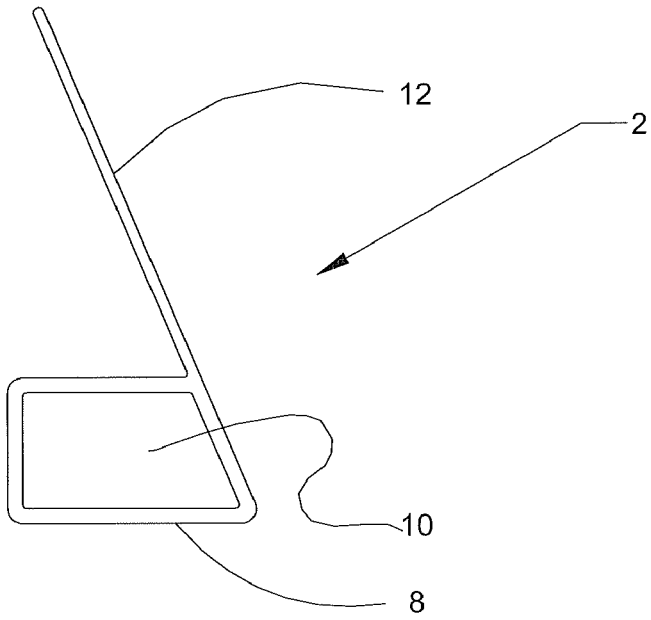
FIG. 2 is an end view of a second present preferred embodiment of the light holding assembly of our decorative lighting system.
Figure 3:
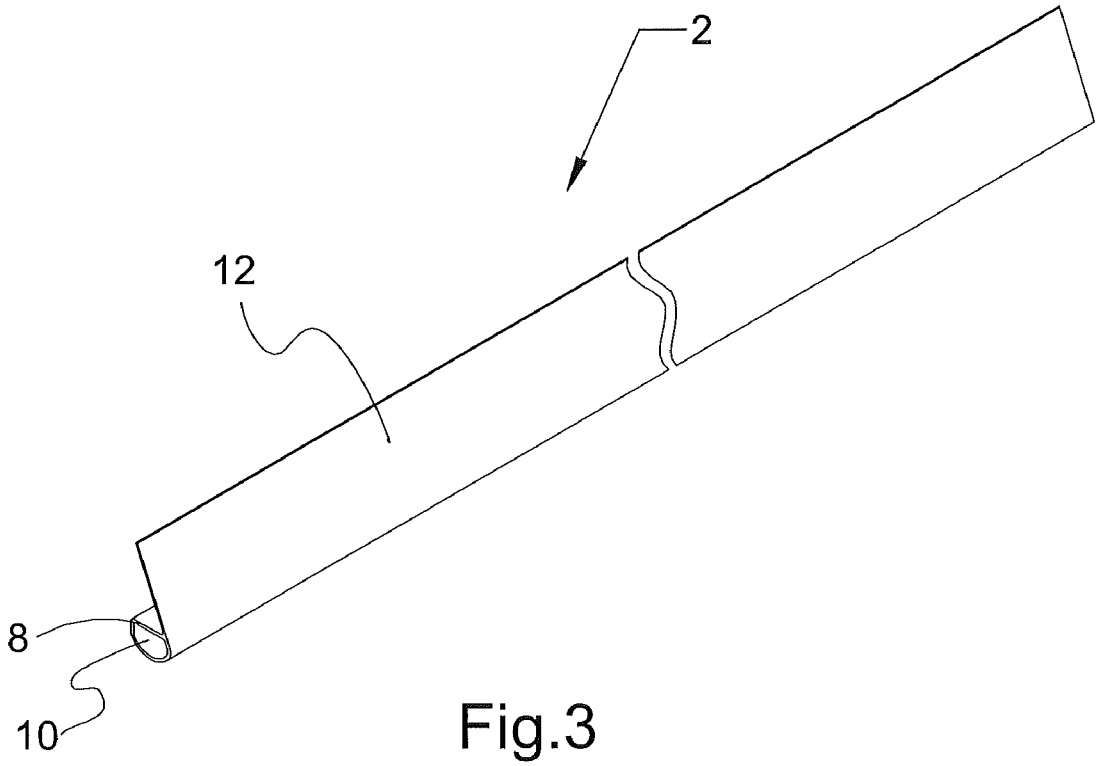
FIG. 3 is a front perspective view of the present preferred embodiment of the light holding assembly shown in FIG. 1.
Figure 4:
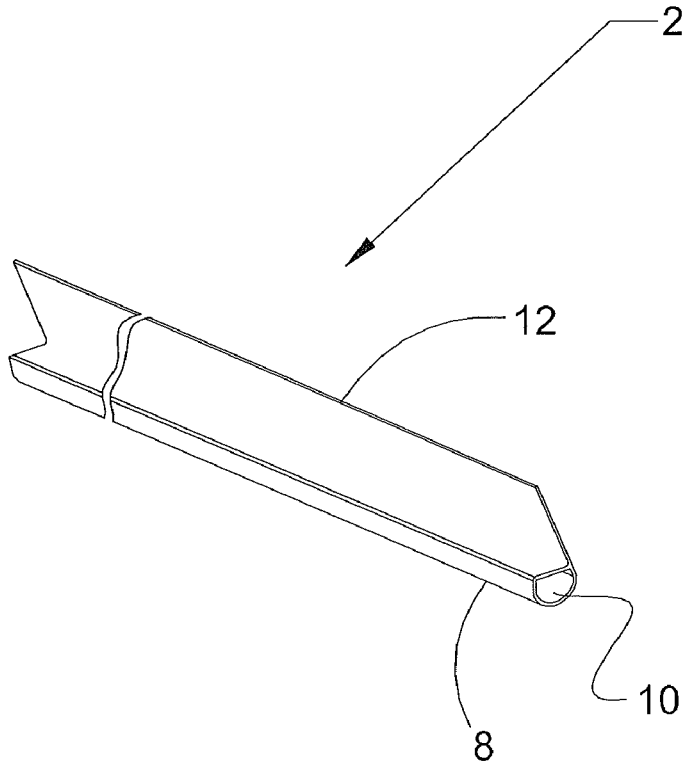
FIG. 4 a rear perspective view of the present preferred embodiment of the light holding assembly shown in FIG. 1.

Referring to FIGS. 1-6, our decorative lighting system 1 has a light holding assembly 2, a base section member 4, and a top section member 6 on the base section member 4. The light holding assembly has an elongated tubular body 8 with a cavity 10 defined therein. The light holding assembly 2 also has a flange 12 that extends from the elongated tubular body 8 and a plurality of lights 14 that are distributed within the elongated tubular body 8.

At least a portion of the elongated tubular body 8 is made of a material that allows light to pass through that portion. Further, at least a portion of the flange 12 is located between the base section member 4 and the top section member 6. The flange 12 is formed such that the light holding assembly 2 is held between the base section 4 member and the top section member 6 of a railing.

Figure 5:
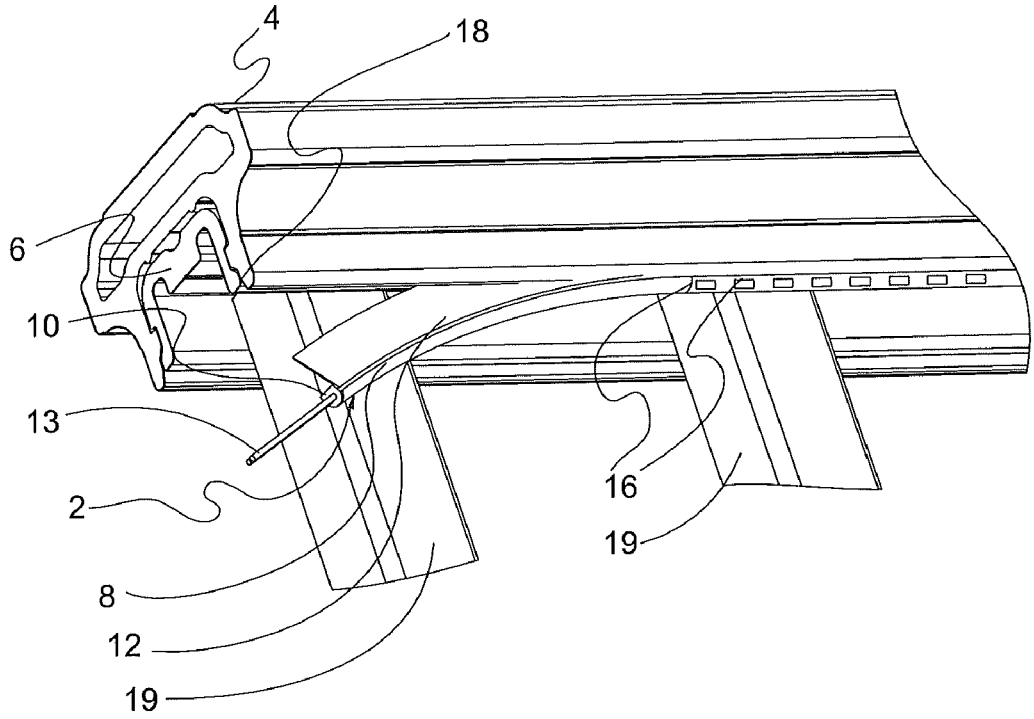
FIG. 5 is a front perspective view of the present preferred embodiment of our decorative lighting system in the form of a lighted railing shown in FIG. 1 with the light holding assembly partially installed.
Figure 6:
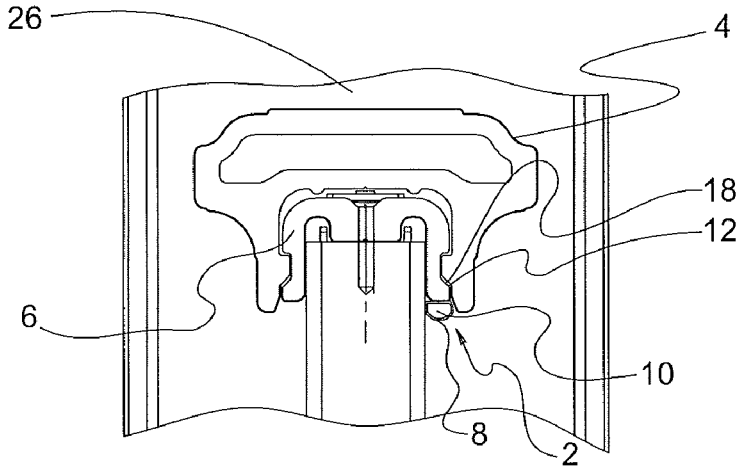
FIG. 6 is an end view of the embodiment of our decorative lighting system shown in FIG. 5 with the light holding assembly fully installed.

In the embodiment shown in FIGS. 5 and 6, the light holding assembly 2 is made from a resilient material, such as plastic, and is manufactured by an extrusion process. The top section member 6 and the base section member 4 are a railing cover 6 and a retainer 4 for the railing cover, respectively. The retainer 4 may be attached to a plurality of balusters 19 and the railing cover 6, which is shown as a handrail, is placed over the retainer 4. The light holding assembly 2 is then pressed into a gap 18 between the retainer 4 and the handrail 6. Lead wires 13 that provide power to the lights 16 located in the cavity 10 of the light holding assembly 2 are shown in FIG. 5. The lead wires may be hidden within one of the posts 26 that support an assembled railing as seen in FIG. 6. Further, the light holding assembly 2 may be sized and configured to provide illumination for the entire length of the handrail 6 or only a section.

Preferably the light holding assembly 2 will be held in place based on an interference fit. The flange 12 is formed from a resilient material and is optimally about 0.15 inches thick to fit into the gap 18 between the top section member 6 and the base section member 4. Further, as can be seen in FIG. 6, the dimensions of the portion of the elongated tubular body of the light holding assembly that allows light to pass through, the light transmissive section, may be such that the light transmissive section is not enclosed by the base section member and the top section member but when the installation is complete.

Figure 7:
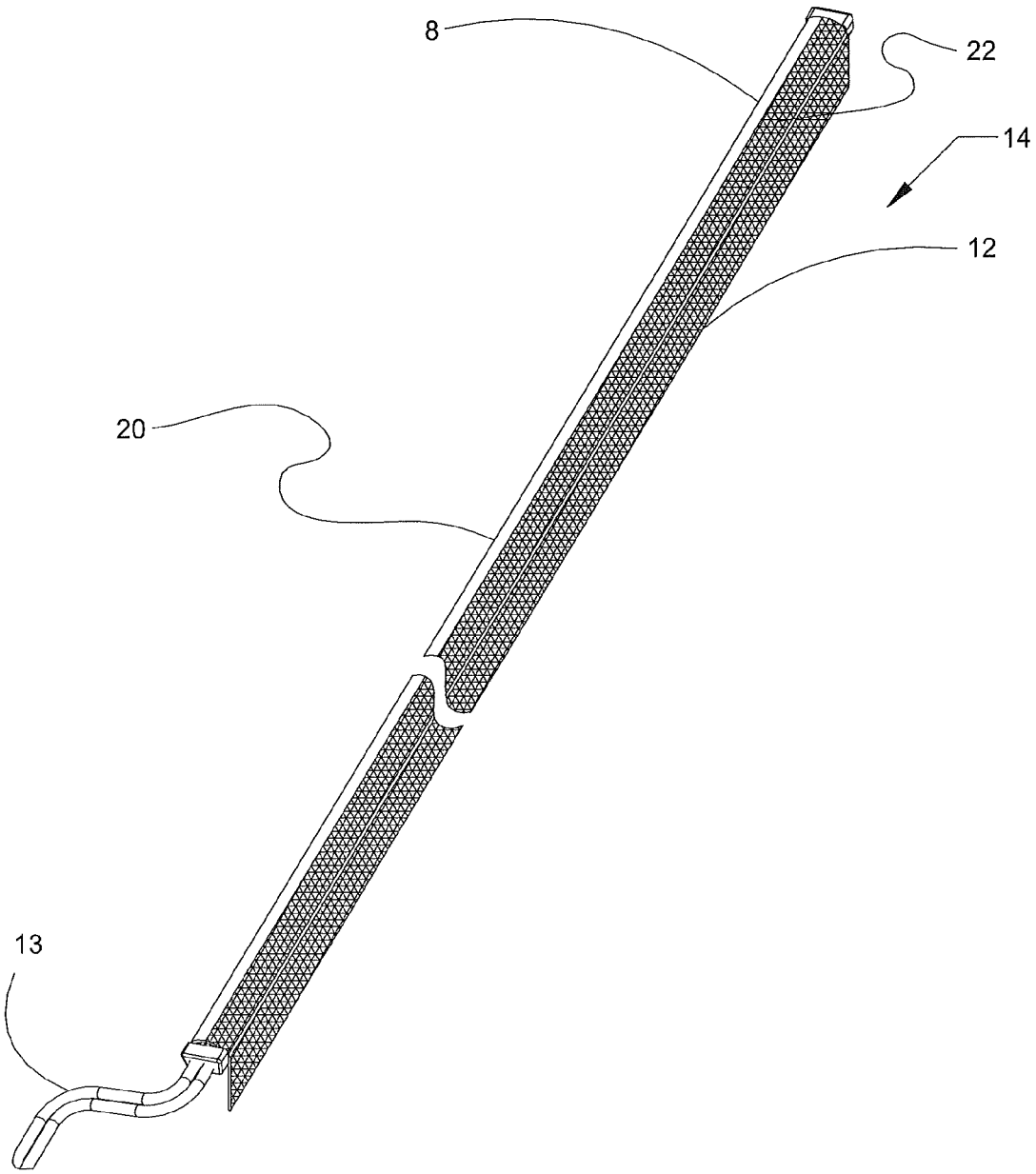
FIG. 7 is a front perspective of another present preferred embodiment of the light holding assembly of our decorative lighting system.
Figure 8:
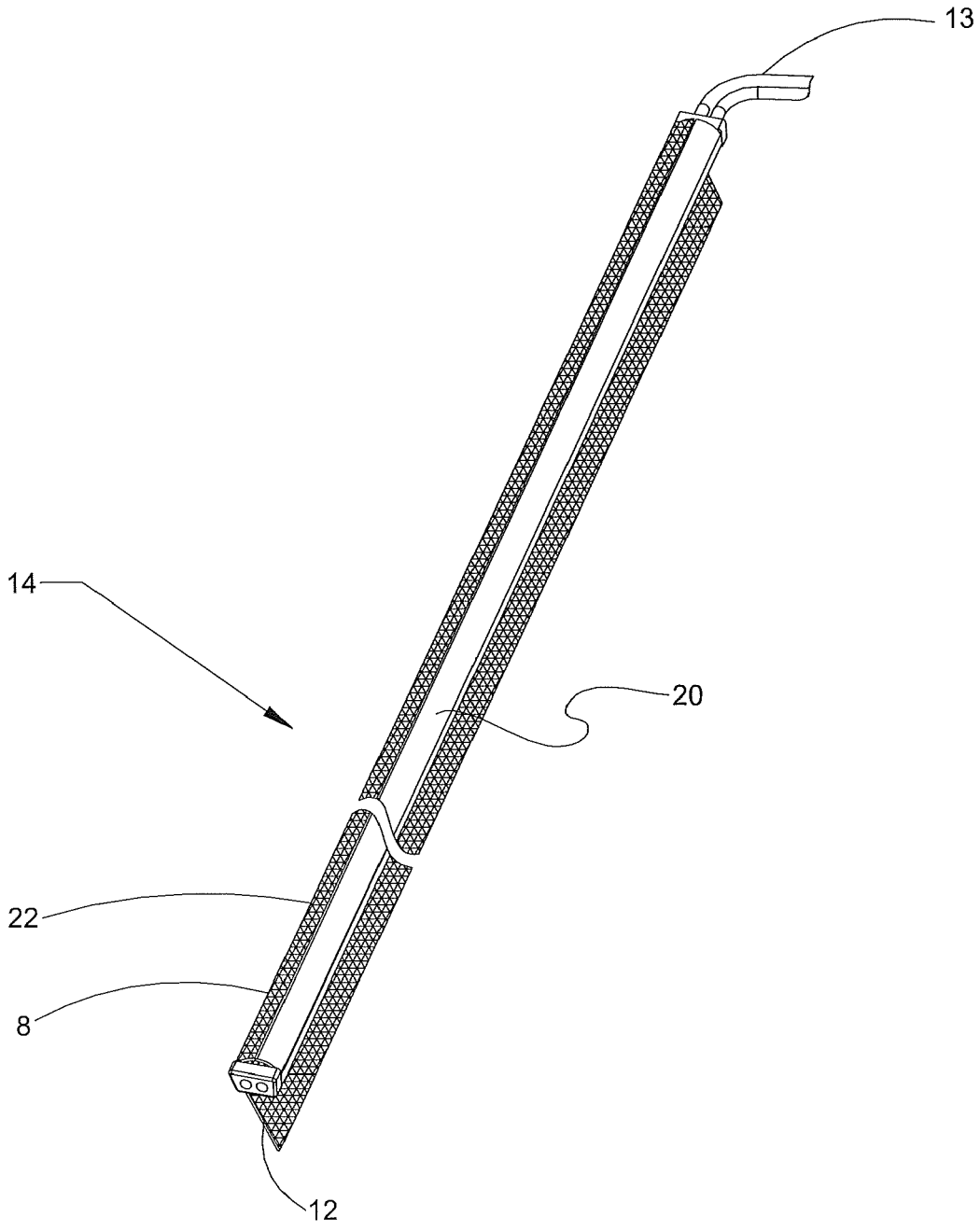
FIG. 8 is a rear perspective of the embodiment of the light holding assembly show in FIG. 7.

Another preferred embodiment of the light holding assembly 14 is shown in FIGS. 7 and 8. As seen in FIGS. 7 and 8, the elongated tubular body 8 consists of a light transmissive section 20 and an opaque section 22. The light transmissive section 20 is a portion of the light holding assembly 14 that allows light to pass through while the opaque section 22 does not. Additionally, the flange 12 is also shown as being opaque to prevent the transmission of undesired light through the flange 12. To produce this light blocking effect, the light holding assembly 14 may be made from a translucent or transparent material that is coextruded with an opaque or dark material that does not allow as much light to pass through. Alternatively, a portion of the light holding assembly 14 may be covered by a material that is opaque or dark, which is applied after the light holding assembly is manufactured. The opaque portion of the elongated tubular body 8 may comprise approximately 50% or less of the elongated tubular body 8 depending of the desired application.

Figure 9:
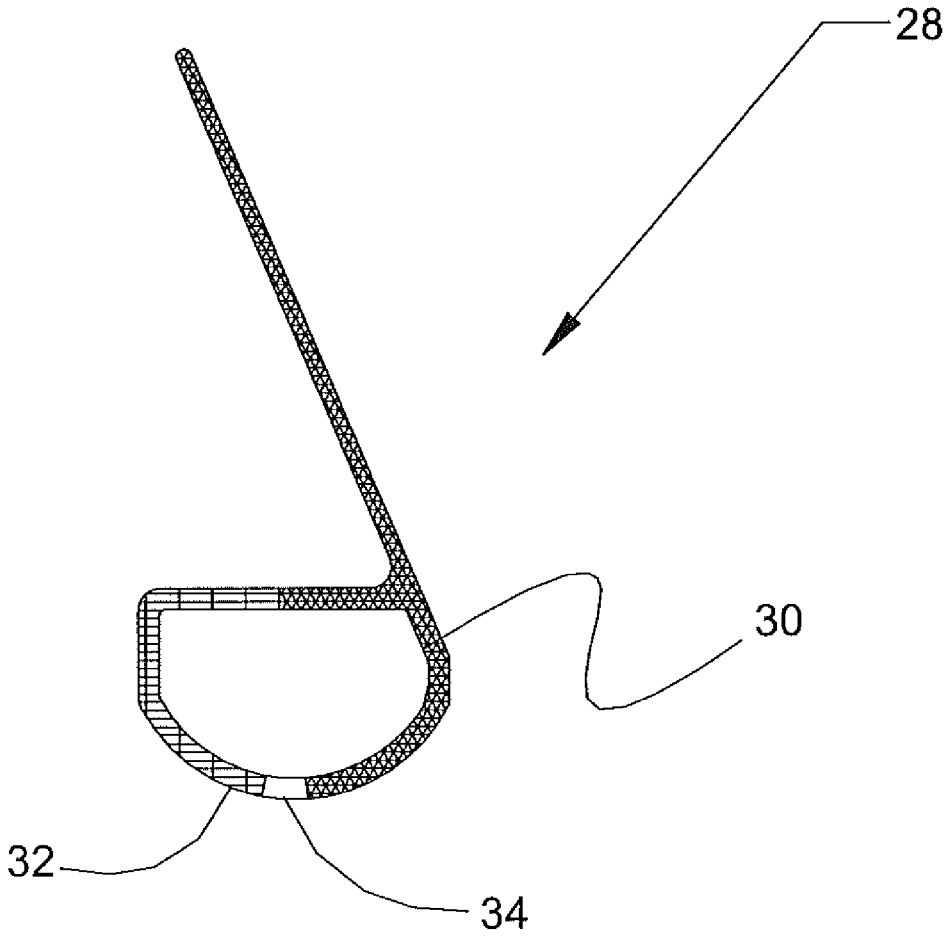
FIG. 9 is an end view of another present preferred embodiment of the light holding assembly of our decorative lighting system.

In another embodiment shown in FIG. 9, the light holding assembly 28 may have an opaque portion that covers approximately 60% of the exposed surface area as illustrated by a first section 30. Alternatively, the opaque portion may be comprise a greater percentage such as 85-95% of the exposed surface area, which may be seen for example, by combining the first section 30 and the second section 32. In that embodiment the light transmissive section may comprise only a third section 34. In other embodiments, the opaque section may comprise as much of the exposed surface area of the light holding assembly as may appropriate for a desired application.

Further, FIGS. 7 and 8 show lead wires 13 for Light Emitting Diodes ("LEDs") (not shown) that can be connected to a direct current or alternating current power source to provide power to the LEDs.

By having a portion of the light holding assembly that does not transmit light, the light that is transmitted through the light holding assembly may be projected in a specific direction. It may be desirable for the light to be projected in a direction that is generally away from the top section member. For example, when the top section member is a railing cover for a railing system it may be desirable to project light below the railing cover and onto a flat surface or set of steps. When using trim pieces around a door it may be more desirable to project the light in outward directions away from a wall. Further, light may be projected in limited directions. For example, the light may be concealed for eye points that are higher than 36 inches. Additionally, the inside surface of the elongated tubular body may be a reflective surface that intensifies the light that is projected through the light holding assembly.

The dimensions of the light holding assembly may be such that the length of the light holding assembly conforms to an associated top section member or associated base section member. For instance, the length may be equal to a factor of a length of the base section member or a length the top section member. Preferable lengths may be in multiples of 2 ft sections, such as 4 ft, 6 ft, or 8 ft.

The cross section of the cavity of the elongated tubular body may have a variety of shapes and sizes. For example, in the preferred embodiment shown in FIG. 1 the cross section of the cavity has a shape that is substantially in the shape of a letter D. As another example, in the embodiment shown in FIG. 2 the tubular body has substantially a trapezoidal shape. The size and shape of the cavity depends on the materials and dimensions of the components of the decorative lighting assembly. Those skilled in the art will recognize that shapes other than those shown in the drawings may be used for the cavity.

The shape of the cavity may also affect how the flange is formed in connection with the elongated tubular body. Accordingly, an angle equal to 90 degrees or less than 90 degrees may be formed between the flange and the tubular body of the light holding assembly.

In a preferred embodiment, the lights used with the light holding assembly are LEDs. The LEDs are provided with a coating or covering, such as epoxy, prior to being placed in the cavity of the tubular body. Furthermore, the LEDs may be provided in strips of a predetermined length, such as 4 ft, 6 ft, or 8 ft, to coordinate with the length of the light holding assembly and accordingly the lengths of the base section and top section members. The LED strips may also have designated cut areas that allow for the strips to be cut to a preferred length without affecting the function of the LEDs. For example, after every third LED in an LED strip there may be a designated cut line. Additionally, the preferred dimensions of a strip of LEDs is a width of 5 mm, a height of 3.5 mm, and the distance between each LED in a strip is 16⅔ mm.

The LED strips may have lead wires or a plug and socket that form an interconnection point so that individual strips can be combined to form a longer strip of a desired length. The lead wires or plug and socket may be at either end of an LED strip to allow for flexibility in a design. Further, connecting lead wires may consist of using wire nuts, whereas interconnection points may allow for a simpler and more visibly pleasing appearance. Other forms of lights may be used as well, for example an appropriately shaped flexible string of lights may be used. The type and number of lights will be dictated by the size and shape of the cavity of the light holding assembly and would be apparent to one of ordinary skill in the art.

While the base section member and top section member have been described in an example as a retainer and a corresponding railing cover, the base section member and the top section member may also be components of an interlocking decorative trim system. The base section member may be a backing strip and the top section member may be a cover strip. A front face of the cover strip may be formed to have various decorative features. The light holding assembly may be placed in a gap between the backing strip and the cover strip similar to the retainer and handrail example shown in FIGS. 5 and 6. Applications may include a frame of a window or door, or anywhere where trim or molding is applied, such as baseboard or crown molding.

A cover strip or railing cover may have a different appearance based on an owner's desire or need. This may allow a retailer to offer a wide variety of decorative variations. In addition, the cover strip or railing cover can be pre-finished, formed, or manufactured from a dyed material such that the front face of the cover strip can remain unmarked and will not require any other surface preparation or coating.

Additionally, the base section member and top section member of the railing may be manufactured from the same material or different materials depending upon the desire of a user and the requirements of the particular installation. The base section member and top section member may be manufactured from various materials, including wood plastic composites, polyurethane, cellular PVC, and aluminum. Further, base section member and top section member may be manufactured through routing, molding, extrusion, or any other suitable manufacturing technique.

The decorative lighting system may also be a kit that has a light holding assembly, a base section member, and a top section member that is sized and configured to connect to the base section member. In a preferred embodiment the kit may further include a plurality of lights that are sized to fit within the elongated tubular body of the light holding assembly.

While we have shown and described certain present preferred embodiments of our decorative lighting system and have illustrated certain present preferred methods of making and using the same, it is to be distinctly understood that the invention is not limited thereto but may be otherwise variously embodied and practiced within the scope of the following claims.

We claim:

1. A decorative lighting system comprising:

a light holding assembly comprising:

an elongated tubular body having a cavity defined therein, a flange extending from the elongated tubular body, and a plurality of lights within the elongated tubular body; and a base section member; and a top section member on the base section member;

at least a portion of the elongated tubular body being made of a material that allows light to pass through that portion; and at least a portion of the flange being between the base section member and the top section member such that the light holding assembly is held between the base section member and the top section member.

2. The decorative lighting system of claim 1 wherein a portion of the light holding assembly is covered by a material that is opaque.

3. The decorative lighting system of claim 1 wherein the light holding assembly is made by an extrusion process.

4. The decorative lighting system of claim 1 wherein the light holding assembly is made of a resilient material.

5. The decorative lighting system of claim 1 wherein a cross section of the cavity has a substantially trapezoidal shape.

6. The decorative lighting system of claim 1 wherein a cross section of the cavity has a shape that is substantially the shape of a letter D.

7. The decorative lighting system of claim 1 wherein an angle equal to 90 degrees or less than 90 degrees is formed between the flange and the tubular body of the light holding assembly.

8. The decorative lighting system of claim 1 wherein the elongated tubular body has a light transmissive section, and wherein the light transmissive section of the elongated tubular body is not enclosed by the base section member and the top section member.

9. The decorative lighting system of claim 7 wherein light transmitted by the light transmissive section is projected in a direction that is away from the top section member.

10. The decorative lighting system of claim 1 wherein the plurality of lights are a plurality of light emitting diodes.

11. The decorative lighting system of claim 1 wherein the plurality of lights comprise a flexible strip of lights.

12. The decorative lighting system of claim 1 wherein the light holding assembly has a length that is equal to a factor of a length of the base section member or a length the top section member.

13. The decorative lighting system of claim 1 wherein the plurality of lights comprises a string of Light Emitting Diodes, the string having designated cut areas.

14. The decorative lighting system of claim 1 wherein the light holding assembly is held between the base section member and the top section member based on a interference fit.

15. A lighted railing comprising:

a light holding assembly comprising:

an elongated tubular body having a cavity defined therein, a flange extending from the elongated tubular body, and a plurality of lights within the elongated tubular body; and a retainer; and a railing cover on the retainer;

at least a portion of the elongated tubular body being made of a material that allows light to pass through that portion; and at least a portion of the flange being between the retainer and the railing cover such that the light holding assembly is held between the retainer and the railing cover.

16. A kit for a decorative lighting system comprising:

a light holding assembly comprising:

an elongated tubular body having a cavity defined therein, and a flange extending from the elongated tubular body; and a base section member; and a top section member that is sized and configured to connect to the base section member;

wherein at least a portion of the tubular body is made of a material that allows light to pass through that portion; and wherein at least a portion of the flange is sized to fit between the base section member and the top section member such that the light holding assembly is held between the base section member and the top section member when they are connected.

17. The kit of claim 15 further comprising a plurality of lights sized and configured to fit within the elongated tubular body of the light holding assembly.

18. The kit of claim 15 wherein a portion of the light holding assembly is covered by a material that is opaque.

19. The kit of claim 15 wherein the light holding assembly is made by an extrusion process.

20. The kit of claim 15 wherein the light holding assembly is made of a resilient material.

* * * * *